United States Patent [19]

Elmer

[11] 4,044,729

[45] Aug. 30, 1977

[54] AUTOMOTIVE COOLING FAN DRIVE INCLUDING FRICTION CLUTCH

[76] Inventor: Arthur Ernest Henry Elmer, Merry Lodge, Court Orchard, Painswick, Gloucestershire, England

[21] Appl. No.: 634,152

[22] Filed: Nov. 21, 1975

[30] Foreign Application Priority Data

Oct. 10, 1975 United Kingdom ..... 41562/75

[51] Int. Cl.[2] ..... F01P 7/02

[52] U.S. Cl. ..... 123/41.12; 192/82 T; 416/169 A

[58] Field of Search ..... 123/41.12; 192/82 T, 192/58 B, 91 A, 58 A, 58 C; 416/169

[56] References Cited

U.S. PATENT DOCUMENTS

| | | | |
|---|---|---|---|
| 3,467,071 | 9/1969 | Elmer | 123/41.12 |
| 3,684,397 | 8/1972 | Elmer | 123/41.12 |
| 3,872,842 | 3/1975 | Medley | 123/41.12 |
| 3,893,555 | 7/1975 | Elmer | 123/41.12 |
| 3,902,663 | 9/1975 | Elmer | 123/41.12 |

*Primary Examiner*—Carroll B. Dority, Jr.
*Assistant Examiner*—Daniel J. O'Connor
*Attorney, Agent, or Firm*—Young & Thompson

[57] ABSTRACT

A cooling fan drive for the motor of a vehicle has a fan drive hub with the fan blades at the front end and a bracket at the rear end for mounting on the motor. An internal friction clutch connects the fan blades to an external casing formed with grooves to receive driving belts. The clutch is operated by a pneumatic ram at the rear end of the assembly near the mounting bracket and compressed air to actuate the ram is admitted at the rear end through an air line from a thermostat valve in the coolant circuit.

9 Claims, 2 Drawing Figures

AUTOMOTIVE COOLING FAN DRIVE INCLUDING FRICTION CLUTCH

Figure 1:
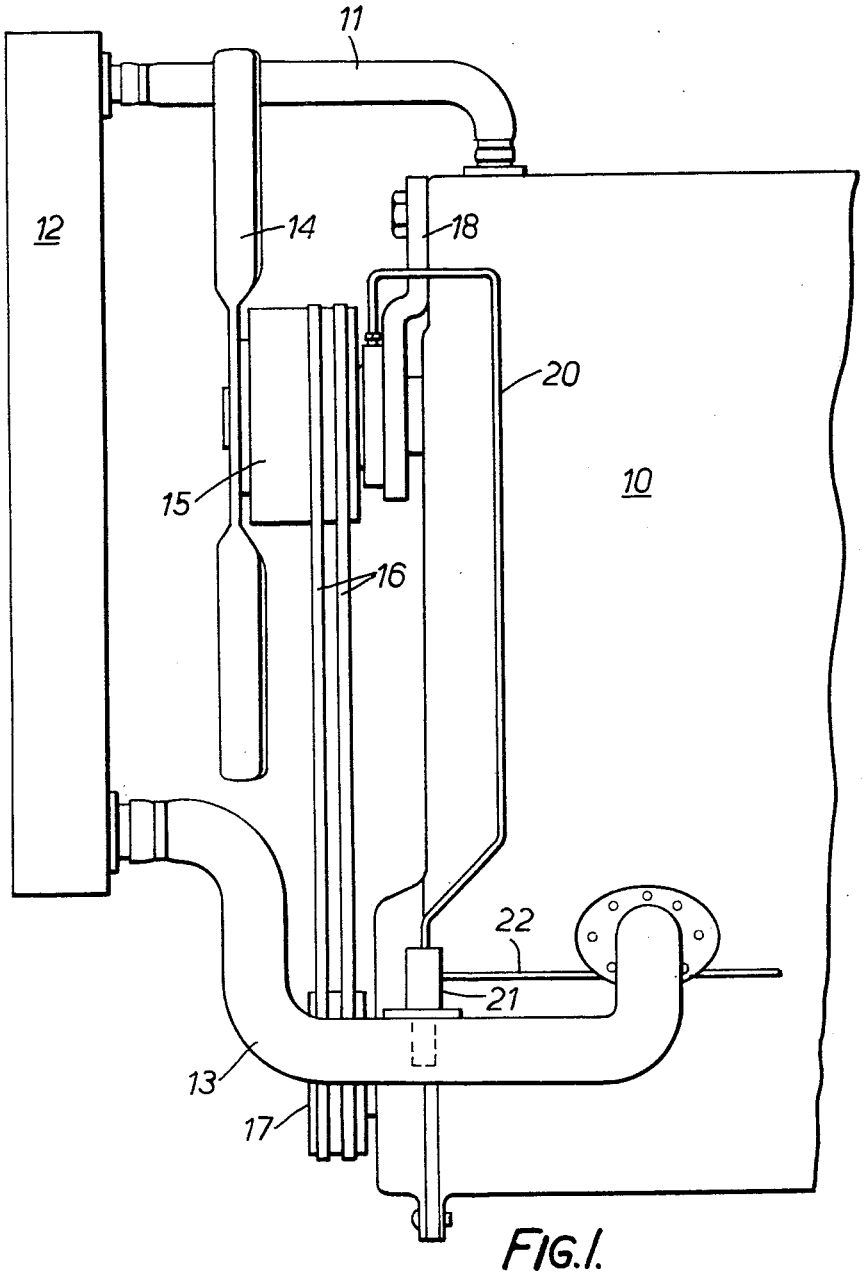

This invention relates to variable speed cooling fan drives, intended primarily for use with internal combustion engines.

Such cooling fans are used with air-cooled engines, but primarily the liquid cooled engines in which the coolant is circulated through a radiator through which cooling air is impelled by the fan. In many operating situations the cooling effect of an engine driven fan is superfluous, for example in cold weather when a vehicle is descending a long hill. In other situations, however, there will be a need for substantial torque and power input to the fan, for example when the vehicle is heavily loaded and climbing a steep gradient. Accordingly, it is an advantage to provide means varying the drive to the fan so as to economise in operating costs and also reduce the vibration and noise created unnecessarily by a high speed fan.

Many different proposals have been made for driving such fans at variable speeds and it is an object of the invention to provide a new and improved fan drive, particularly suitable for use with engines where the fan is designed to be mounted on a bracket and driven by a fan belt rather than directly off a crankshaft, layshaft, camshaft or water pump shaft.

Broadly stated the invention consists in a cooling fan assembly comprising a support member formed with means for attachment to a stationary mounting, an axially movable fan blade carrying element supported for rotation and axial movement relative to said support member, a rotary drive member located axially by a thrust bearing relative to said support member, a friction clutch acting between the drive member and the blade carrying element, a spring acting on the blade carrying element in a direction to engage the clutch, and a nonrotating fluid operated ram arranged to oppose the spring to disengage the clutch.

Preferably the fan blades are mounted at the front end of the assembly, and the mounting and support member, and also the fluid input line to the ram are located at or adjacent the rear end. The ram itself is also conveniently located near the rear end. The drive member may be in the form of a casing surrounding the clutch, and also part of the support member, and the casing conveniently has a pulley attached or is formed with a belt drive groove. In a particular preferred construction the support member is a hollow sleeve, the drive member surrounds and is supported on the sleeve, and the blade carrying member is located by bearings partly within the sleeve, and has its rear end connected through a thrust bearing to the ram.

The invention is to be distinguished clearly from designs in which the fan blades and their mounting are fixed axially while some other component part is caused to move to engage or disengage a clutch. In such arrangements the axial thrust created by the fan blades themselves cannot be used to augment the clutch engaging force. In the present invention this blade reaction force is used to reinforce the spring acting on the clutch and both therefore provide a "fail safe" effect, if for example the supply of air to the pneumatic ram should fail.

Conveniently the ram is controlled by an oil or pneumatic thermally actuated valve located in the liquid coolant circuit, preferably in the lower hose connection between the radiator and the engine block. If the coolant temperature at this point falls below a predetermined value a wax capsule moves to open the valve and allow air pressure into the ram chamber to disengage the clutch and so interrupt the drive to the fan.

Figure 2:
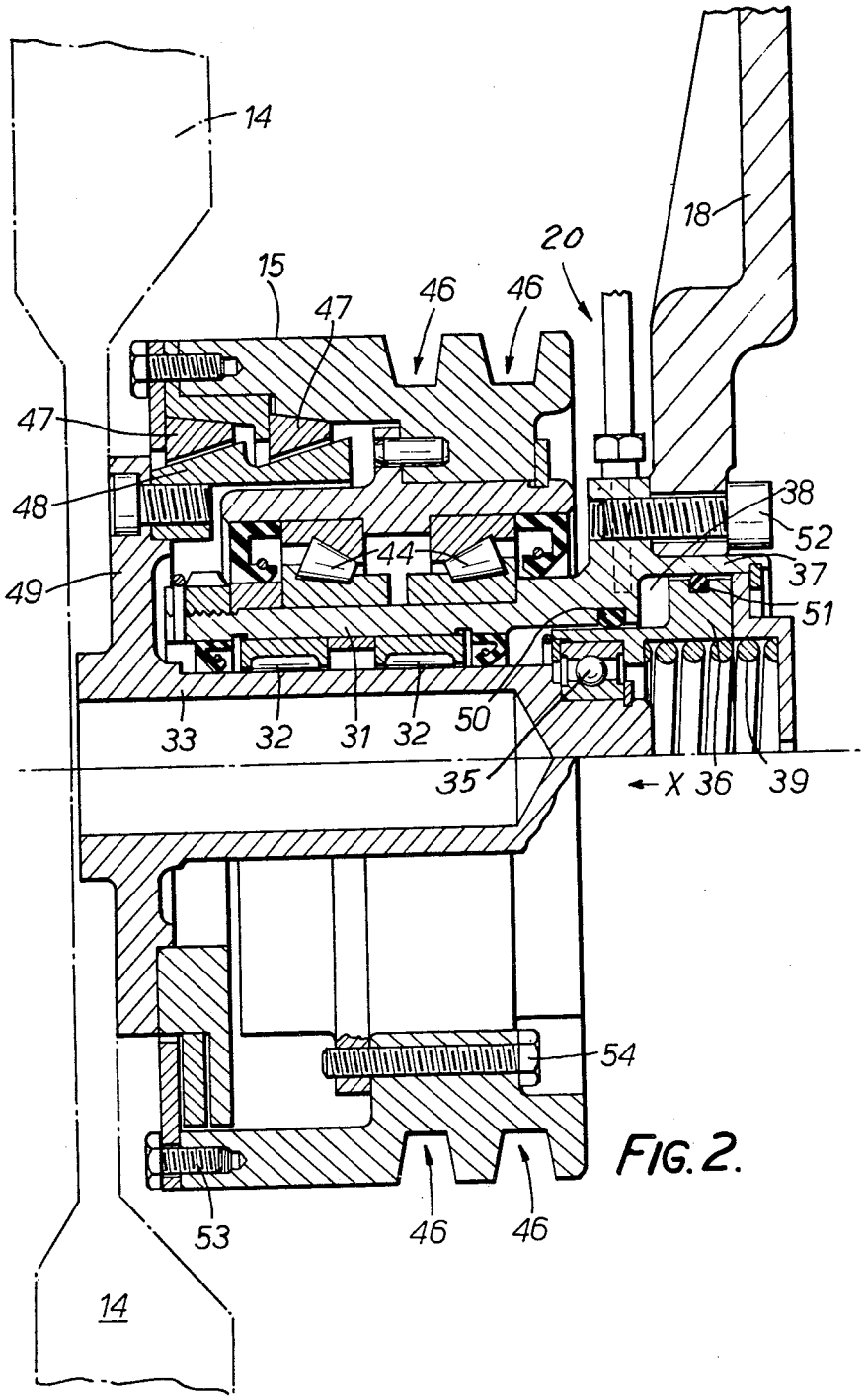

The invention may be performed in various ways and one specific embodiment with some possible modifications will now be described by way of example with reference to the accompanying drawings, in which:

FIG. 1 is a partial side elevation illustrating a cooling fan drive according to the invention in relation to the other components of an engine coolant circuit, and FIG. 2 is a sectional elevation through the fan drive hub on an enlarged scale, the lower part of the figure illustrating a modified form of clutch.

Referring to FIG. 1, a cylinder block 10 for an internal combustion engine of a motor vehicle is provided with a water cooling jacket through which cooling water is circulated through a top flexible hose connection 11, a radiator 12 and a lower hose connection 13. There may be a water pump included in the cooling circuit in conventional manner, driven in conjunction with a cooling fan 14 and, in addition, the circuit will normally include a conventional thermostat valve and bypass to restrict water flow when the temperature is below a preselected value.

The cooling fan 14 forms a part of a fan drive assembly including an internal friction clutch to be described in more detail below and a hub casing 15 which is continuously driven by a pair of fan belts 16 from a lower pulley 17 driven by the crankshaft of the engine. The complete fan drive assembly is supported from the cylinder block 10 by means of a bracket 18 located at the rear end of the assembly. The internal clutch is operated by a compressed air line 20 which is introduced into the assembly at its rear end adjacent the bracket 18, the control of compressed air to operate the clutch being automatically governed by a thermostat valve 21 located in the lower radiator hose 13 so as to be responsive to the coolant water temperature. Compressed air to operate the clutch is supplied through a line 22 from a suitable source of compressed air on the vehicle. When the temperature of the coolant water returning to the cylinder block through the bottom hose connection 13 exceeds a preselected temperature, the thermostat valve 21 closes to cut off the supply of compressed air to the line 20 and the internal friction clutch in the fan drive is automatically engaged by a built-in spring. Accordingly the fan 14 is driven and cooling air is drawn through the radiator. This results in further cooling of the water and when the temperature at the thermostat valve 21 falls below the selected value the valve opens, compressed air is admitted to the ram, via the line 20, and the clutch is disengaged thus interrupting the drive to the fan.

The valve 21 may take various forms and one particular example is illustrated in U.S. Pat. No. 3,738,571.

FIG. 2 illustrates in detail a practical example of a fan hub according to the invention. The whole assembly is intended to be supported solely by the bracket 18 secured to the engine block 10. This bracket is secured to a hollow fixed sleeve or spigot 31 which extends forwards and surrounds a pair of needle roller bearings 32 within which is mounted a hollow shaft 33 on whose front end is mounted the fan itself 14. At the rear end of this shaft a thrust bearing 35 provides a thrust connection between the shaft and an axially movable pneumatic ram piston 36 sliding within a ram chamber 37 which defines an actuating pressure chamber 38. A compression spring 39 also acts on the ram piston 36 in the direction illustrated by the arrow X and so transmits an axial force through the thrust bearing 35 on to the fan blades. Compressed air to actuate the ram is admitted through the static line 20 from the thermally actuated control valve 21 located in the lower radiator hose connection of the motor.

Surrounding the fixed sleeve 31 are a pair of tapered roller thrust bearings 44 carrying the rotary clutch casing 15 which is formed with a pair of annular grooves 46 for the fan driving belts 16. The casing 15 is also arranged to support a pair of tapered clutch driving members 47 arranged to cooperate with corresponding tapered clutch driven members 48 bolted to a flange 49 at the front end of the fan drive shaft 33. The clutch members 47 are axially fixed and the clutch members 48 are axially movable with the fan, to engage or disengage the clutch.

It will be noted that the ram piston 36 is non-rotary and also the ram cylinder 37. The associated seals 50 and 51 are also both non-rotary and therefore subject to little wear. The forces required to engage the clutch are transmitted simply through the thrust bearing 35 and when the clutch is engaged this is subject to a certain amount of wear, but only for a small proportion of the running time of the motor. For the greater part of its working life the clutch is disengaged and there is little load on the bearing 35 or the bearings 44. The design is essentially "fail safe" as explained above, and it will be noted that if the clutch linings should wear they can be replaced easily from the front of the unit without stripping the remainder. The design of the basic unit is such that it can be fitted to different mounting brackets 18 to suit different makes of motors by releasing the bolts 52. Also different pulleys can be fitted as required, after the basic unit has been removed from the bracket 18, by releasing the bolts 53, 54 for instance.

The lower part of FIG. 2 illustrates a minor modification in which the clutch is of the plate type. Like parts are illustrated by the same reference numerals and in this embodiment the tapered driven clutch members 48 are replaced by an annular flange 48' connected to the member 49, the driving clutch members 47 being replaced by the flange 47' secured to the casing 15 of the assembly. A flat annular friction disc 56 is loosely positioned between the parts 47' and 48'. Thus, as in the construction shown in the upper part of FIG. 2, when the hollow drive shaft 33 and member 49 are shifted forwardly by the spring 39, the flange 48' grips the friction disc 56 between it and the flange 47' and so engages the clutch, the fan blades being then driven at the same speed as the casing 15.

I claim:

1. A cooling fan drive assembly comprising a static support member formed with means for attachment to a stationary mounting, an axially movable fan blade carrying element supported for rotation and axial movement relative to said support member, a rotary drive member located axially by a first thrust bearing relative to said support member, a friction clutch comprising an input clutch element connected to said drive member and an output clutch element connected to said blade carrying element, a spring acting on said blade carrying element in a direction to engage said clutch, a nonrotating fluid operated ram, a second thrust bearing interposed between said ram and said blade carrying element, and a fluid input connection to said ram, located on said static support member, said ram being arranged to oppose said spring to disengage said clutch.

2. A cooling fan drive assembly according to claim 1, in which said static support member is located at the rear end of said assembly, and said fan blade carrying element is located at the front end of said assembly.

3. An assembly according to claim 2, in which the ram is also located at the rear end of the assembly.

4. An assembly according to claim 1, in which the drive member is constructed as a casing surrounding the clutch.

5. An assembly according to claim 1, in which the drive member is provided with, a belt drive groove. groove.

6. An assembly according to claim 1, in which said drive member surrounds and is supported on said static support member.

7. An assembly according to claim 6, in which said static support member is in the form of a hollow sleeve, and said blade carrying element is supported by said sleeve and mounted at least partly inside said sleeve.

8. An assembly according to claim 1, wherein said spring is mounted between non rotary abutments.

9. An assembly according to claim 1, wherein said spring acts on said blade carrying element through said second thrust bearings interposed between said ram and said blade carrying element.

* * * * *